US008734058B1

(12) United States Patent
Schmidt

(10) Patent No.: US 8,734,058 B1
(45) Date of Patent: May 27, 2014

(54) METHOD OF PILING REMEDIATION FOR SUPPORTING GIRDERS AND OTHER STRUCTURAL MEMBERS

(71) Applicant: Harold F Schmidt, Colts Neck, NJ (US)

(72) Inventor: Harold F Schmidt, Colts Neck, NJ (US)

( * ) Notice: Subject to any disclaimer, the term of this patent is extended or adjusted under 35 U.S.C. 154(b) by 0 days.

(21) Appl. No.: 14/097,943

(22) Filed: Dec. 5, 2013

(51) Int. Cl.
*E02D 5/64* (2006.01)

(52) U.S. Cl.
USPC ..... 405/255; 52/835

(58) Field of Classification Search
CPC ..... E02D 5/223; E02D 5/64; E04B 1/2612
USPC ..... 405/232, 250, 251, 255; 52/263, 283, 52/296, 835, 848
See application file for complete search history.

(56) References Cited

U.S. PATENT DOCUMENTS

| | | | | | |
|---|---|---|---|---|---|
| 1,073,614 | A * | 9/1913 | McDearmid | 405/251 |
| 2,664,977 | A * | 1/1954 | Starcevich | 52/301 |
| 3,003,323 | A * | 10/1961 | Holt | 405/251 |
| 4,009,550 | A * | 3/1977 | Young | 405/251 |
| 4,032,244 | A * | 6/1977 | Quayle | 403/286 |
| 4,313,688 | A * | 2/1982 | Daniels | 403/189 |
| 4,537,534 | A * | 8/1985 | Marsh, Jr. | 405/252 |
| 4,604,003 | A * | 8/1986 | Francoeur et al. | 405/256 |
| 5,570,675 | A * | 11/1996 | Treadway | 124/23.1 |
| 5,718,851 | A * | 2/1998 | Wadas, Jr. | 264/32 |
| 6,254,314 | B1 * | 7/2001 | Park et al. | 405/255 |
| 6,893,598 | B1 * | 5/2005 | March | 264/267 |
| 7,351,013 | B2 * | 4/2008 | Anderson | 405/232 |
| 8,579,548 | B1 * | 11/2013 | Schmidt | 405/251 |
| 2004/0047693 | A1 * | 3/2004 | Nishiwaki et al. | 405/250 |

* cited by examiner

*Primary Examiner* — Benjamin Fiorello
(74) *Attorney, Agent, or Firm* — Stuart M. Goldstein

(57) ABSTRACT

A method for supporting and securing structural members, such as girders, to remediated pilings utilizes a pipe segment and cap plate positioned on the planed top section of the piling and welded to the pipe segment. Structural member supports, such as girder brackets or lally type jacks, are secured to the cap plate. The girder is positioned on the structural member supports and is secured thereto. By this method the girder is solidly and effectively supported by a fully formed, reinforced piling.

6 Claims, 10 Drawing Sheets

METHOD OF PILING REMEDIATION FOR SUPPORTING GIRDERS AND OTHER STRUCTURAL MEMBERS

FIELD OF THE INVENTION

The present invention relates to methods of reconditioning and reforming old or deteriorating in situ pilings, especially timber pilings, and, more particularly, to preparing these pilings for connection to and for supporting girders and like structural members.

BACKGROUND OF THE INVENTION

Pilings are utilized in a variety of different environments and for many uses, e.g. in marine environments for supporting and reinforcing piers and vessel docking structures, in the construction industry for supporting and framing buildings, for structure supporting foundations, and supporting and maintaining raised homes and buildings in flood prone areas. The structural members such as girders are quite often utilized on pilings to provide the foundation support for such structural members.

Regardless of the environment or context, pilings, which routinely and advantageously are wood or timber pilings, will eventually erode, deteriorate, rot or otherwise become damaged as a result of the passage of time, weather, wear and tear, wave and tidal action in marine situations, insect infestations, battering, etc. In many cases, the lower, less exposed section of the piling sustains far less damage, since it is often not directly affected by weather, it is imbedded in the ground and/or, in marine circumstances, may have cathodic protection. As a result, when deterioration of or damage to the upper section of a piling has become very severe, even though the piling's lower section is in tact, the piling must be repaired or totally replaced.

This is especially significant where pilings are relied upon to maintain and support homes and buildings above ground in shore communities, near oceans, lakes or rivers. In these areas, damage from flooding often damages the upper sections of support pilings, requiring pile replacement.

However, total replacement of pilings is an expensive and involved process, especially in marine environments. Even the repair of pilings is quite costly and time consuming, since these types of repairs usually involve the construction of a wall, cofferdam, or like barrier around the piling, with the subsequent removal of ambient water, in order to provide a dry space in which to work.

When it is necessary to secure girders or like supporting structural members to existing pilings, the current practice known as "banding" requires that a section of the piling be cut out to accept the girder, which is then attached to the piling. FIG. 1 depicts typical piling banding, in which section 202 of piling 200 is cut out and girder 203 is positioned within the section. Bolts/nuts 204 extend through piling 200 and girder 203 to secure the girder to the piling. This common method has the obvious deleterious effect of severely weakening the piling, which now must support the girder with less than its full structural compliment.

These time-consuming processes, many of which provide less than effective structural connections, and their resulting expense are exacerbated when major catastrophes create the need to address numerous piling failures. Property damage, such as occurred as a result of superstorm Sandy in 2012, highlights the need for effective, efficient, and economical means to repair deteriorated and partially destroyed pilings and their supporting structures. Such is needed not only to connect in situ pilings to new pilings in routine situations, e.g. docks, piers, docking stations, etc., but also for emergent construction, for instance to renew damaged pilings which support raised homes and other building structures in flood plague locations. In fact, new government requirements since Sandy require existing homes, buildings, and other shoreside structures to be built on timber pilings, raised to new elevations of up to three feet or more.

SUMMARY OF THE INVENTION

It is thus the object of the present invention to provide a method for remediating and reforming pilings and efficiently and effectively securing girders and other supporting structural members to the rehabilitated pilings.

These and other objects are accomplished by the present invention, a method for supporting and securing structural members, such as girders, to remediated pilings utilizing a pipe segment and cap plate positioned on the planed top section of the piling and welded to the pipe segment. Structural member supports, such as girder brackets or lally type jacks are secured to the cap plate. The girder is positioned on the structural member supports and is secured thereto. By this method the girder is solidly and effectively supported by a fully formed, reinforced piling.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
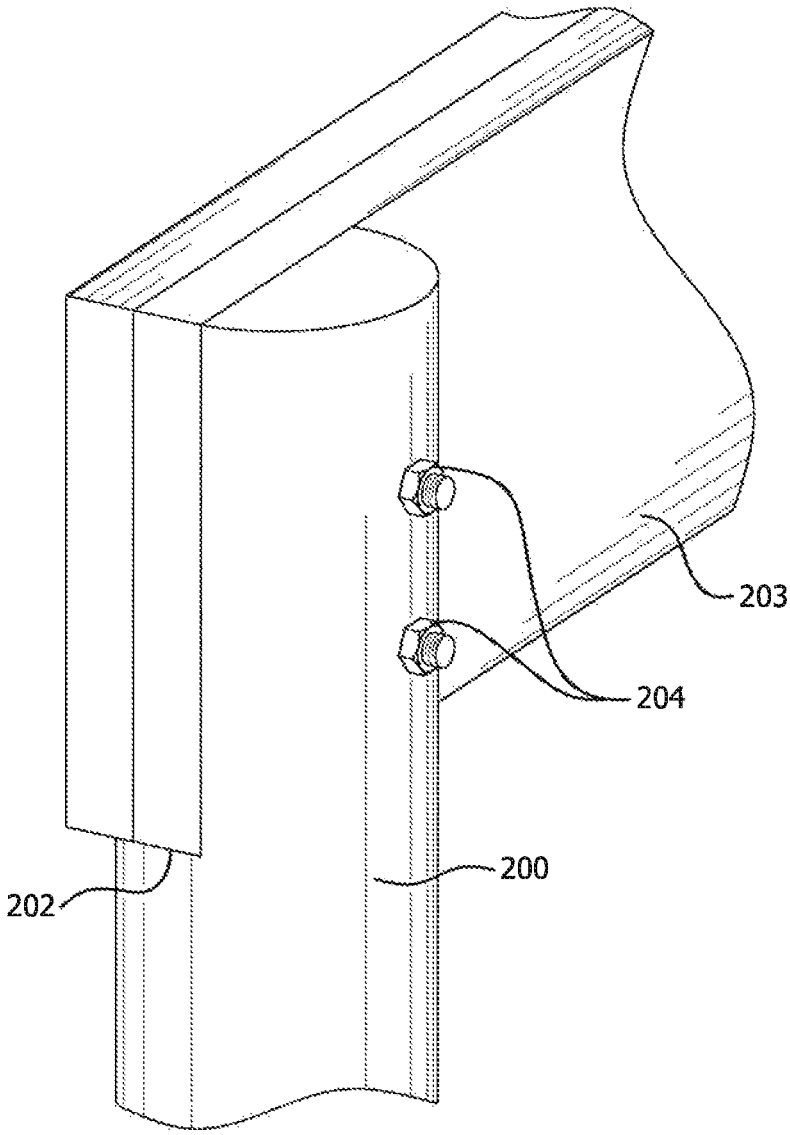
FIG. 1 (Prior Art)
FIG. 1 depicts a prior art method of securing or banding a structural member, such as a girder, to a piling.

The piling planing tool 1 used in the method of the present invention has been initially disclosed in co-pending application Ser. No. 13/888,469. A method of use of tool 1 is disclosed in U.S. Pat. No. 8,579,548. Planing tool 1 and its method of operation are depicted in FIGS. 2-6.

Piling planing tool 1 comprises unitary, cylindrically shaped cutter head 2 having circular top wall 4, bottom circular ring 6, and circular middle section 8, with sidewall 10 extending between the top wall and bottom ring. Top wall 4 and bottom ring 6 each extend past sidewall 10 of middle section 8. Top wall 4 and middle section 8 encompass internal space 12 which extends through bottom ring 6. Cutter head 2 has an open bottom. For purposes of context, it is contemplated that the height of cutting head 2, from its top wall 4 to bottom ring 6, will be approximately four to six inches.

Drill bits 14 and 16, sized to be in excess of one inch in diameter, extend through top wall 4 and into and out of internal space 12. Longer drill bit 14 is initially utilized in the method of the invention, and is replaced by smaller drill bit 16 during the later steps of the method, as will be described hereinafter. The drill bits are secured to cutter head 2 by means of motive power connection means, e.g. mandrel 18/lock nut connection 20, on the top surface of top wall 4. Drill bits 14 and 16 are configured to be attached to a power motive means, e.g. feed mag drill 22, which raises, lowers, and rotates the bits, as well as the other components of planing tool 1. For purposes of context, it is contemplated that drill bit 14 will be approximately 30-36 inches long and drill bit 16 will be approximately four to six inches long. However, the dimensions of the drill bits are not to be considered restricted to those stated herein.

Piling planing means, e.g. circular flat cutting blade 24 with downwardly extending cutting teeth 26 on the lower surface of the blade, is located parallel to and below top wall 4, in internal space 12. Blade 24 is secured to top wall 4 by screws 25 extending from the top wall. Blade 24 has an opening through which drill bits 14 and 16 extend and is mounted perpendicularly to the drill bits.

Figure 2:
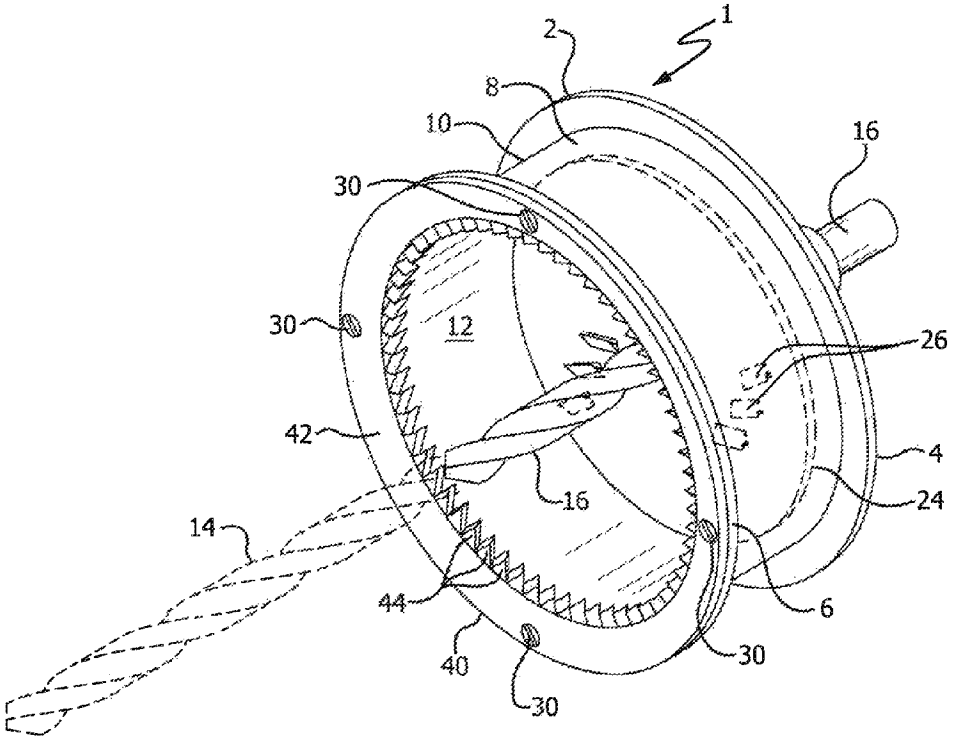
FIG. 2 is a bottom isometric view of the planing tool used in the method of the present invention, without its spacer rings attached.
Figure 3:
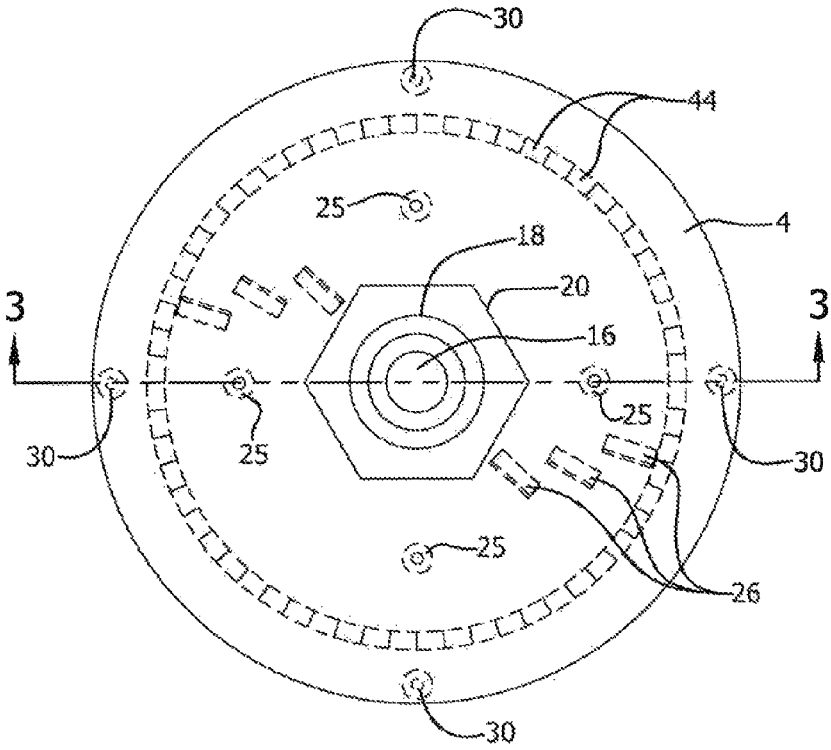
FIG. 3 is a top view of the planing tool used in the method of the present invention.

Bottom ring 6 has openings for the insertion of screws 30 which attach cutter head 2 to cutter ring 40, as shown in FIG. 2, and subsequently to spacer rings 60*a* and 60*b*, as described below.

Second planing means, e.g. cutter ring 40, comprises circular outer rim 42 having an inner circular edge with downwardly extending planing teeth 44 circumferentially located within the outer rim of the cutter ring. Outer rim 42 has openings for the insertion of screws 30 which attach cutter ring 40 to cutter head 2, as shown in FIG. 2, and subsequently to spacer rings 60*a* and 60*b*, as described below.

As shown in detail in FIG. 4, extension means, e.g. spacer rings 60*a* and 60*b*, are configured to lengthen planing tool 1, during the pile connection method described hereinafter. Spacer rings 60*a* and 60*b* comprise circular top rings 62*a* and 62*b* and circular bottom rings 64*a* and 64*b*, interconnected by circular middle sections 66*a* and 66*b*, and internal spaces 68*a* and 68*b*. The top and bottom rings of spacer rings 60*a* and 60*b* extend past middle sections 66*a* and 66*b* and each has openings for the insertion of screws 30 which attach spacer ring 60*a* to cutter head 2, screws 31 which attach spacer ring 60*a* to spacer ring 60*b*, and screws 32 which attach spacer ring 60*b* to cutter ring 40.

As will be described hereinafter, the length of planing tool 1 will be changed, as the method progresses, by attaching additional spacer rings to the planing tool. It is contemplated that, for purposes of the herein method, planing tool 1, with cutter head 2, cutter ring 40, and two spacer rings 60*a* and 60*b* attached, will reach a length of approximately 30-36 inches, but such is not to be considered so restrictive. It should be understood that additional spacer rings could be added if there is a need to extend the length of the planing tool.

Figure 4:
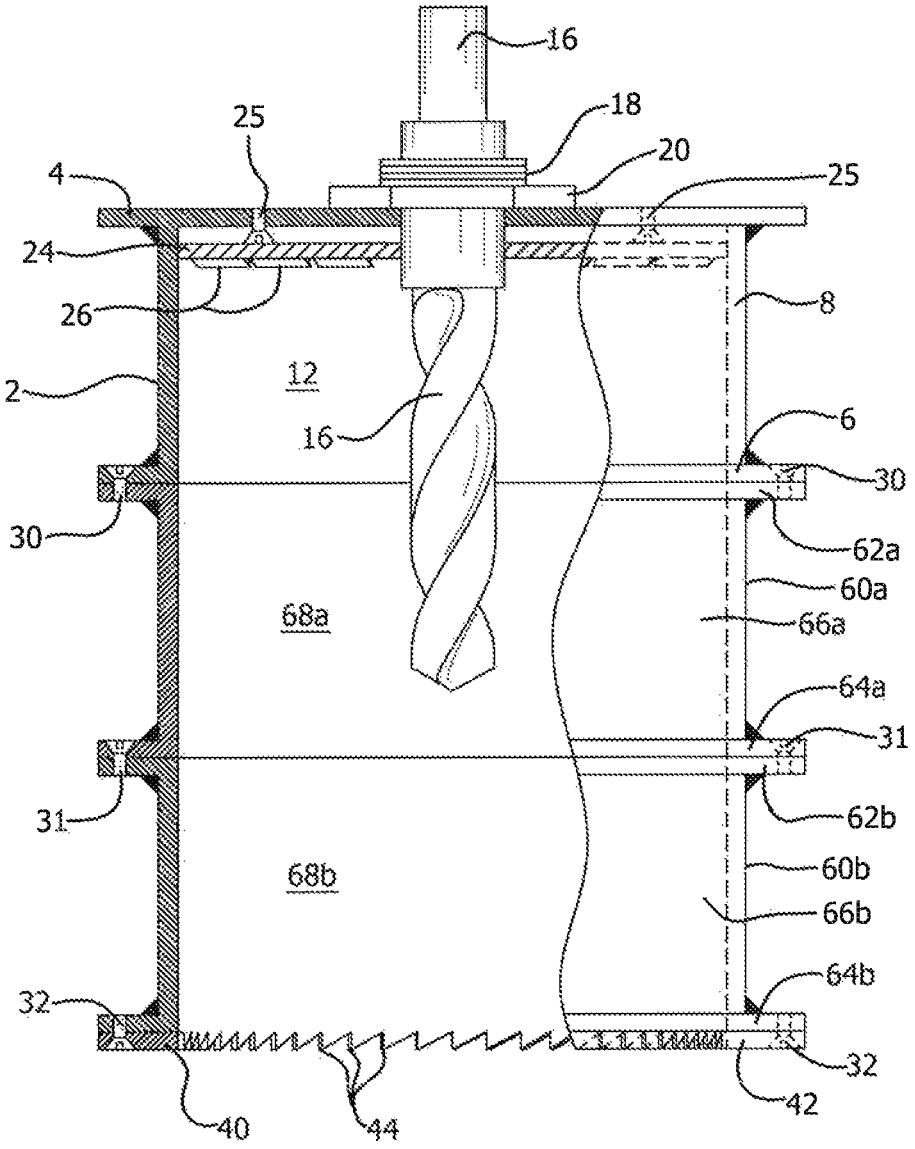
FIG. 4 is a partial cross-sectional view of the planing tool used in the method of the present invention, taken from FIG. 2, with its spacer rings attached.
Figure 6:
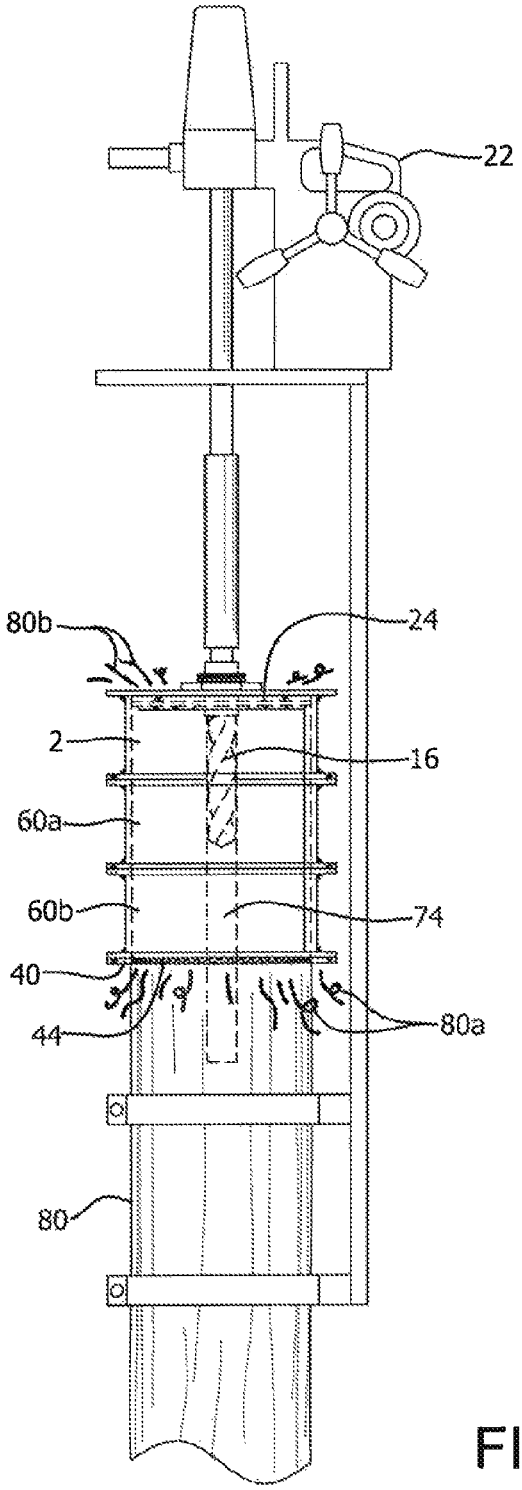

For example, FIGS. 4 and 6 show planing tool 1 with cutter head 2 attached to spacer ring 60*a*, spacer ring 60*a* attached to spacer ring 60*b*, and spacer ring 60*b* attached to cutter ring 40. Drill bit 16 extends partly through the components making up planing tool 1, as is described below.

The dimensions of planing tool 1 are critical and contribute to its uniqueness, in that the tool must be capable of encircling an in situ piling and of planing a significant length of the outer surface of the piling in order to accomplish the piling remediation method of the invention. As such, planing tool 1 is an integral component in the basic piling connection method of the present invention.

Figure 5:
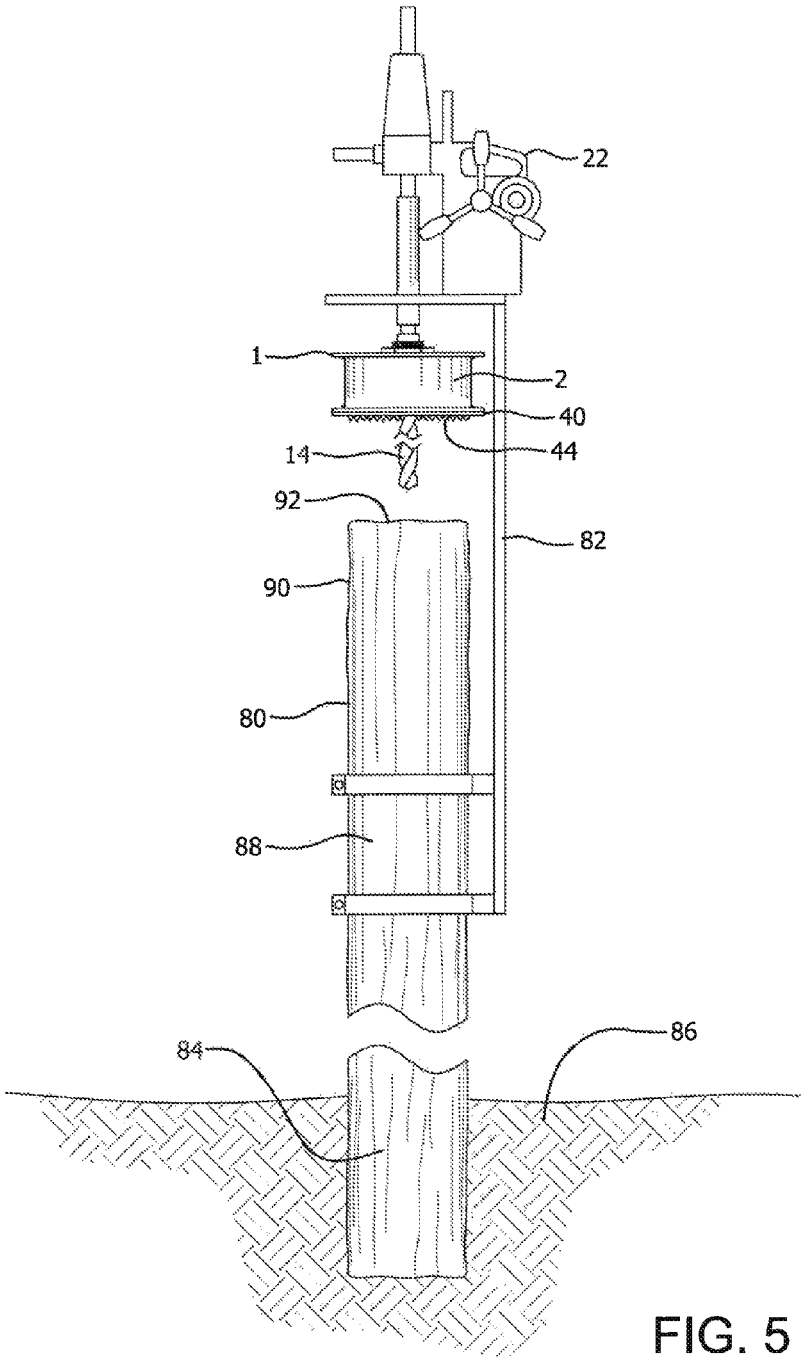
FIGS. 5-6 depict the steps of the method of planing pilings, used in the method of the present invention.

As seen in FIG. 5, planing tool 1 is attached to feed mag drill 22, which itself is maintained on existing, in situ piling 80, by support bracketing 82 or an equivalent support. Lower portion 84 of piling 80 is imbedded into the ground or seabed 86, depending on the targeted environment. Upper portion 88 extends above ground and, as a result of age, ambient conditions, wear and tear, and similar deteriorating factors, has rough, worn and uneven outer surface 90 and top surface 92. Again as shown in FIG. 5, planing tool 1 is initially positioned over top surface 92 of piling 80, with longer drill bit 14 centered over the piling. At this initial stage, planing tool 1 is comprised of cutter head 2 connected directly to cutter ring 40 by screws, as previously described.

Feed mag drill 22 is actuated to lower and then rotate cutting tool 1 at high speed, e.g. 100-1000 RPM. As the bitter end of rotating drill bit 14 contacts top surface 92 of piling 80, it begins boring center channel 74 (see FIG. 6) through the piling. When rotating cutter ring 40 reaches piling 80, its circumferential rotating planing teeth 44 begin planing outer surface 90 of the piling. When cutting blade 24 contacts top surface 92 of piling 80, it begins shaving and planing the top surface, thus smoothing the top surface, ultimately creating a flat, concentric top surface.

After outer surface 90 of piling 80 is planed for a distance equal to the height of planing tool 1, with cutter head 2 and cutter ring 40 attached, rotation of the cutting tool is halted and it is lifted above the piling by feed mag drill 22. Cutter ring 40 is detached from cutter head 2 and one or more of the spacer rings 60*a* and 60*b* are inserted between and attached to the cutter ring and cutter head by screws in the top and bottom rings of the spacer rings and to the cutter ring and cutter head, as previously described. At this point, drill bit 14 has bored center channel 74 into piling 80 to the requisite depth to perform the method. Drill bit 14 is now removed and replaced with smaller bit 16, e.g. one which is shorter than the current length of planing tool 1. Drill bit 16 now serves to assist in the stability of planing tool 1 as it continues to plane outer surfaces 90 of piling 80.

After planing tool 1 has been lengthened with space rings 60*a* and 60*b*, feed mag drill 22 is again actuated to lower and rotate the cutting tool and its rotating cutter head 2 with rotating cutting ring 40 to continue planing outer surface 90 of piling 80, thus shaving off outer surface pieces 80*a*, and, by means of cutting blade 24, planing off top surface pieces 80*b*.

The process of planing outer surface 90, by adding spacer rings 60*a* and 60*b* as previously described, continues until smooth milled piling section 93 is created. Milled piling section 93 has a diameter less than the diameter of piling 80 and lip surface 95 is formed along the bottom end of the milled section of the piling. The piling has been planed such that its milled section 93 is a given length, typically approximately two feet, and comprises smooth level top surface 92 which is substantially perpendicular to outside surface 95 of the piling. In this manner, piling 80 has been prepared to support a structural member, such as girder 100.

Cylindrical pipe segment 102 is provided having an internal diameter slightly larger than the diameter of milled piling section 93. Pipe segment 102 is thus sized to snugly fit around milled piping section 93, such that the bottom of the pipe segment rests on lip surface 95 and its top edge 104 extends up to and substantially level with smooth top surface 92 of the piling. In this position, outside surface 106 of the pipe segment is in substantially the same vertical plane as outside surface 90 of the non-milled section of piling 80.

Figure 9:
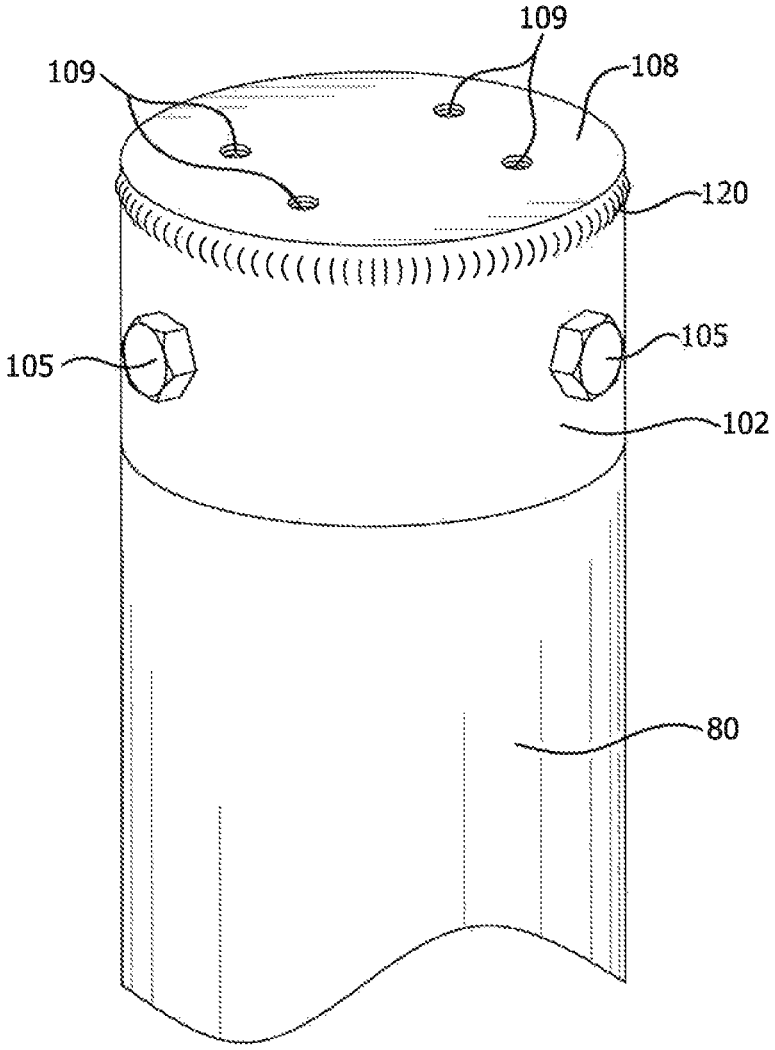
FIGS. 9-11 depicts the continuing steps in completing the method of the present invention.

Flat cap plate 108 with threaded openings 109 is next positioned atop smooth top surface 92 of piling 80 and top edge 104 of pipe segment 102, the top surface having been milled flat for bearing maximum loads. Weld 120 is applied around top edge 104 to permanently secure cap plate 108 to pipe segment 102. Bolts 105 extend through holes 107 of pipe segment 102 and then through holes 110 of milled section 93 of piling 80 to secure the pipe segment to the piling. See FIGS. 7 and 9.

Figure 7:
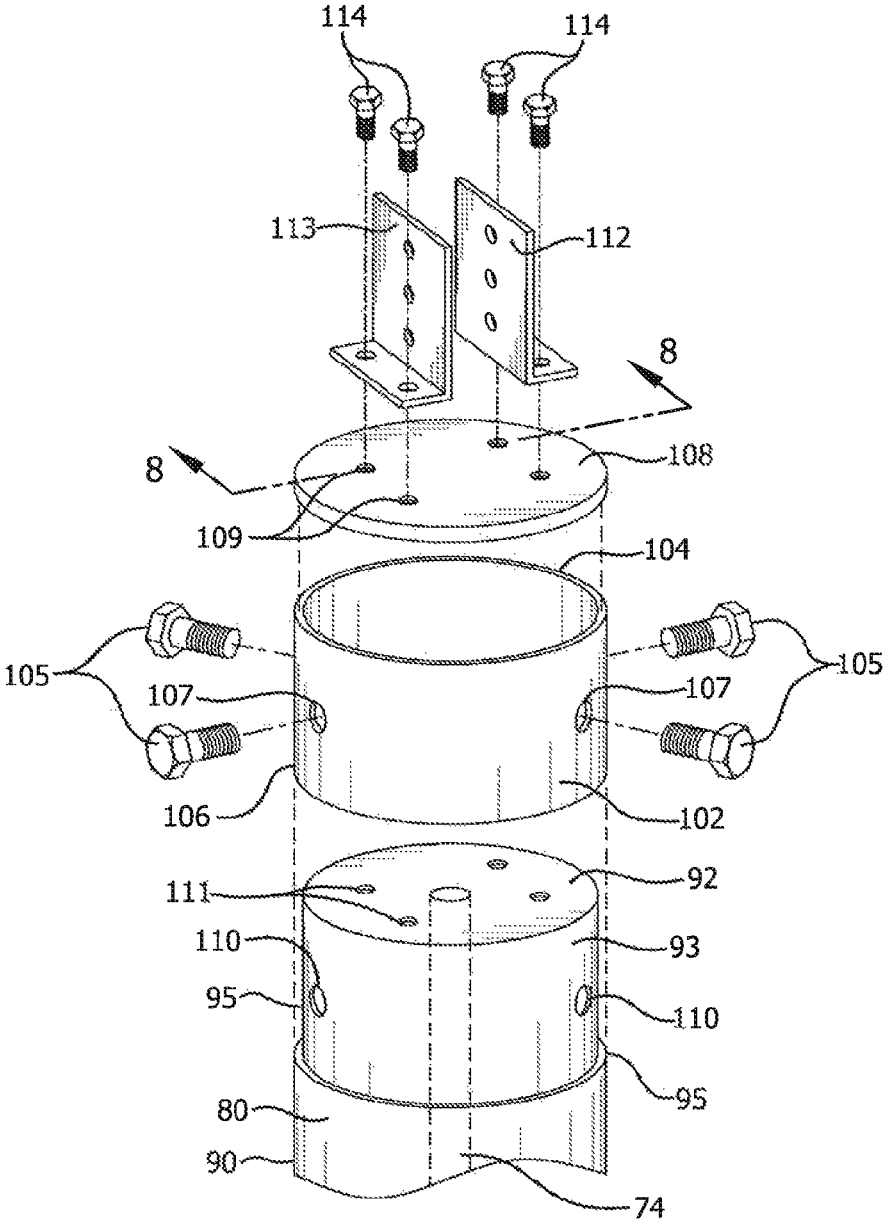
FIG. 7 is an exploded view of the components utilized in the method of the present invention.
Figure 8:
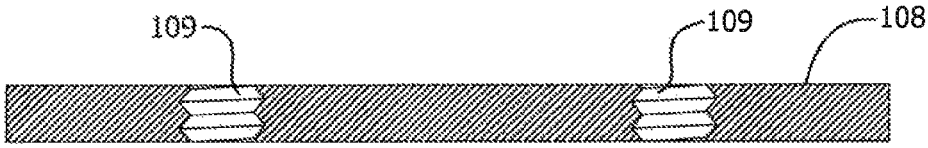
FIG. 8 is a cross-sectional view taken from FIG. 7.
Figure 11:
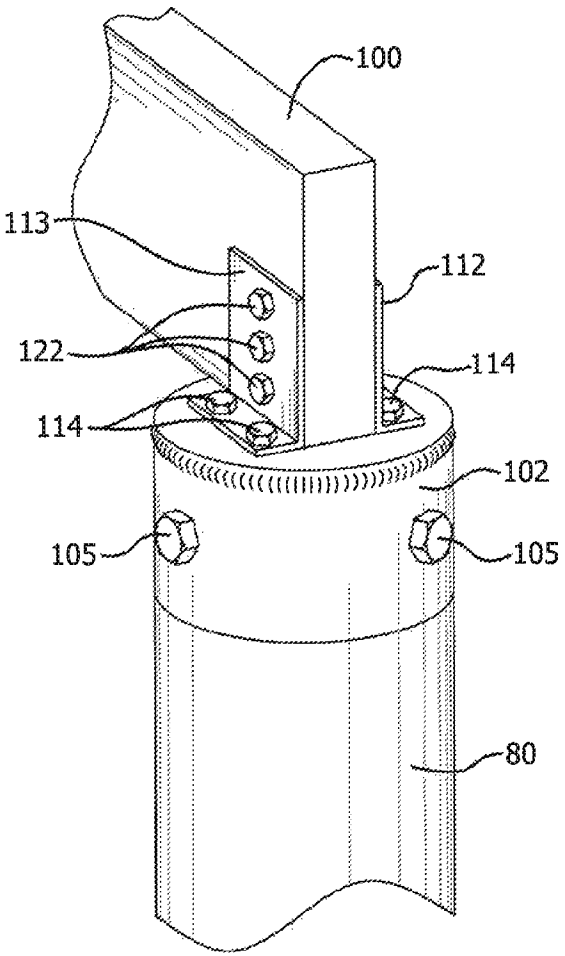
Figure 10:
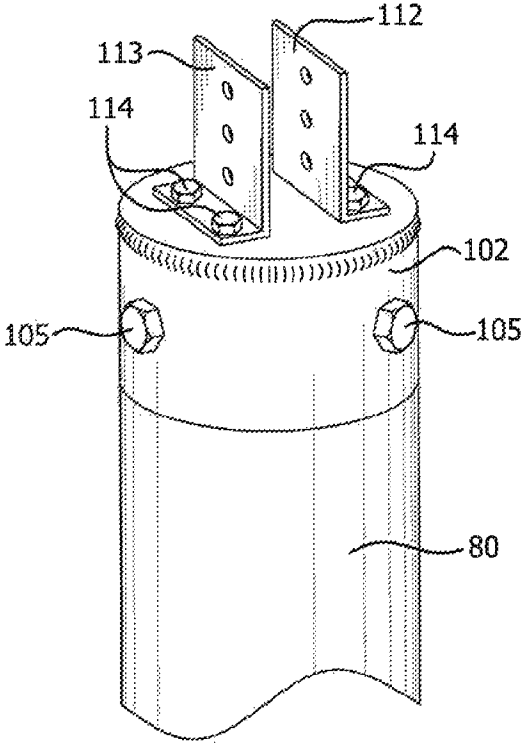

Structural member supports, shown in FIGS. 7, 10 and 11 as girder brackets 112 and 113, are secured by bolts 114 through holes 109 in cap plate 108 and then into holes 111 drilled into piling 80. Girder 100 is then positioned within brackets 112 and 113 and secured therein by bolts 122 into the girder.

Figure 12:
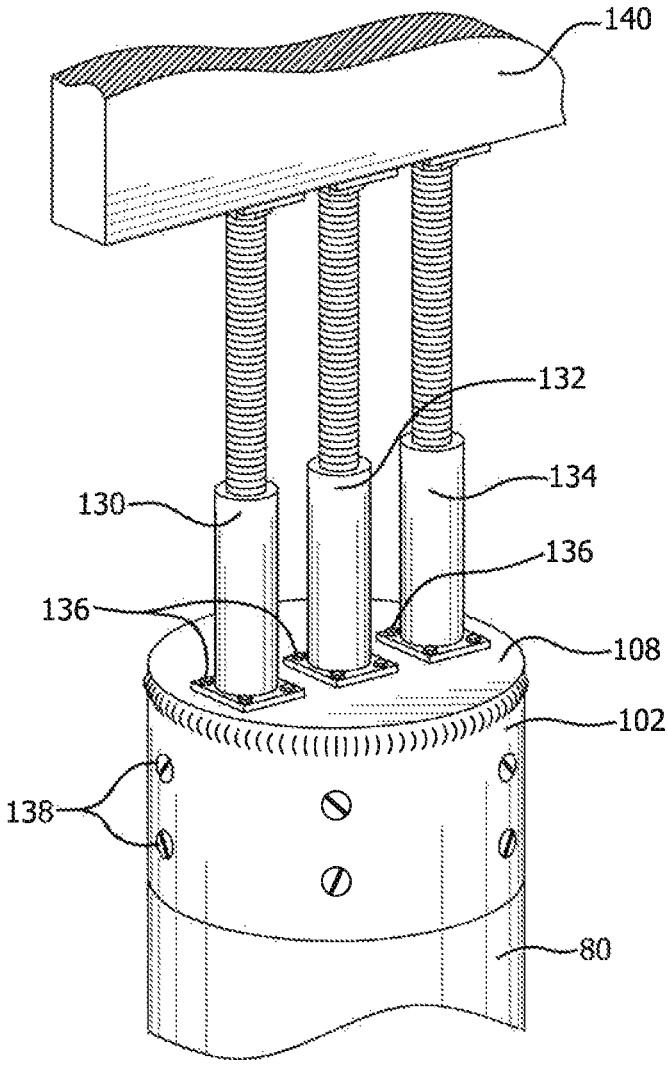
FIG. 12 depicts an alternate structural support member utilized in the method of the present invention.

FIG. 12 shows application of the inventive method utilizing lally screw jacks 130, 132, and 134 as structural support members. In this embodiment, pipe segment 102 is secured to piling 80 by screws 138. The lally jacks are secured by bolts 136 to cap plate 108 and into piling 80. Once secured to the cap plate, the lally jacks are raised up and adjusted sufficiently to contact and support an existing girder 140 or support a newly installed girder. The jacks can be permanently secured to the girder, if necessary. Significantly, bolting jacks to the top of rough, unreformed pilings would be impossible, without the steps of the present inventive method. As a practical matter, and contrary to effective, proper, and safe construction techniques, jacks can not be fastened to the tops of uneven wooden pilings, without fabricating extensive and expensive structural steel supports.

It is anticipated that cap plate 108 would be constructed of steel, e.g. approximately one quarter inch thick for girder brackets 112 and 113 and up to one half inch thick when lally jacks 130, 132, and/or 134 are used. Since cap plate 108 is installed on smooth top surface 92 of piling 80, it will be square with the pile and level, thereby permitting effective fastening of structural member supports such as the girder bracket and the lally jacks.

By this method, worn pilings can be reformed and rejuvenated to support girders and like structural members. The method also ensures that such pilings can be effectively installed below existing structures, without the need to move the structures or attempt to calculate and try to "fit" new pilings between in situ pilings and structures.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A method of remediating an in situ piling for supporting a structural member comprising the steps of:

providing an in situ piling of given diameter having a lower portion embedded in the ground and an upper portion with a top surface extending above the ground, the piling having outer surfaces;

providing a cylindrical pipe segment having a given external diameter and given internal diameter;

planing a section of the outer surface of the in situ piling to a diameter less than the internal diameter of the pipe segment;

shaving the top surface of the in situ piling such that it is smooth and substantially perpendicular to the outer surfaces of the piling;

positioning the pipe segment over and around the planed section of the piling, such that the top of the pipe segment is at substantially the same level as the shaved top surface of the piling;

providing a flat cap plate having substantially the same diameter as the external diameter of the pipe segment;

positioning the cap plate on top of the piling and the pipe segment;

permanently securing the cap plate to the pipe segment;

providing a structural support member for securing a structural member;

positioning the structural support member on the cap plate;

permanently attaching the structural support member to the cap plate; and positioning the structural member in relation to the structural support member so as to permanently position the structural member on the piling.

2. The method as in claim 1 wherein the structural support member is a girder bracket and the structural member is a girder positioned within the bracket.

3. The method as in claim 2 comprising the additional step of securing the girder to the girder bracket.

4. The method as in claim 1 wherein the structural support member comprises lally jacks secured to the cap plate.

5. The method as in claim 4 comprising the further step of supporting the structural member on the lally jacks.

6. The method as in claim 5 comprising the further step of adjusting the lally jacks to rigidly maintain the structural member in position.

* * * * *